US005469204A

United States Patent [19]

Kim

[11] Patent Number: 5,469,204

[45] Date of Patent: Nov. 21, 1995

[54] PRINTING WITHOUT MARGINS

[75] Inventor: Jong-woo Kim, Suwon, Rep. of Korea

[73] Assignee: Samsung Electronics Co., Ltd., Kyungki-do, Rep. of Korea

[21] Appl. No.: 314,385

[22] Filed: Sep. 28, 1994

[30] Foreign Application Priority Data

Sep. 28, 1993 [KR] Rep. of Korea ..... 1993-20338

[51] Int. Cl.[6] ..... B41J 13/22

[52] U.S. Cl. ..... 347/218; 346/138; 271/275; 271/277

[58] Field of Search ..... 346/138, 76 PH; 271/275, 277; 347/218

[56] References Cited

U.S. PATENT DOCUMENTS 5,166,705 11/1992 Roh ..... 346/138

5,353,049 10/1994 Ro et al. ..... 346/138

*Primary Examiner*—Huan H. Tran

*Attorney, Agent, or Firm*—Sughrue, Mion, Zinn, Macpeak & Seas

[57] ABSTRACT

A printing method and apparatus for performing printing on leading and trailing edges of the printing paper without leaving a margin. Printing begins when the leading edge of the printing paper is at an initial location of the printing. At this time, the leading edge of the printing paper is sequentially pressed from side to side by a print head.

9 Claims, 6 Drawing Sheets

PRINTING WITHOUT MARGINS

BACKGROUND OF THE INVENTION

1. Field of the Invention

The present invention relates to a printing method and apparatus therefor, and more particularly, to a printing method and apparatus where the image is recorded without leaving margins in the leading and trailing edges of a sheet of printing paper.

2. Description of the Related Art

In general, a thermal transfer printer includes a thermal record head having a predetermined heating device and an ink-deposited ribbon. The ribbon is located between a printing paper and the thermal print head. Thus, the ink can be sublimated in a predetermined pattern by a thermal print head and thus transferred onto the printing paper. A color thermal transfer printer superposingly performs printing three times in order to print a color-separated yellow, magenta and cyan image.

FIG.1 illustrates a conventional thermal transfer printer. A cassette 6 for receiving a printing paper 4 is provided below a drum 2. A guide roller 3 for guiding printing paper 4 supplied from cassette 6 while pressing the paper onto drum 2 is installed on the circumferential surface of drum 2. A clamp 5 for clamping the leading edge of printing paper 4 and rotating together with drum 2 is installed onto a drum shaft 2'. A thermal print head 1 heated by a predetermined heating element is installed above drum 2 to be movable up and down.

Meanwhile, an ink ribbon 7 is provided between thermal print head 1 and printing paper 4. Thermal print head 1 is heated in accordance with a predetermined printing signal, and at the same time, applies pressure to ink ribbon 7 so that ink can be sublimated in a known manner. Thus, an image is printed onto printing paper 4.

In the conventional thermal transfer printer, printing is performed by the following method. First, printing paper 4 is supplied from cassette 6 toward drum 2 and clamped by clamp 5 at the leading edge thereof. Then, clamp 5 and drum 2 rotate together so that the leading edge of printing paper 4 can be located to the point beyond the initial printing location of thermal print head 1 as shown in FIG.1. Of course, if clamp 5 is located at the initial printing location (a central portion under the thermal print head), clamp 5 would interfere with the operation of print head 1 when the print head descends for performing a printing operation. Then, thermal print head 1 descends in order to press/heat ink ribbon 7. Thus, ink is sublimated so that an image is printed.

However, in the conventional thermal transfer printer, since printing paper 4 is transmitted in the state where the leading edge of printing paper 4 is clamped by clamp 5, the leading edge of printing paper 4 is not printed on.

Therefore, as shown in FIG. 10, a margin is made around the printed image, specifically in the leading edge of printing paper 4, which results in a poor appearance.

SUMMARY OF THE INVENTION

It is an object of the present invention to provide a printing method and apparatus which can print an image even on a leading edge of printing paper.

To accomplish the above object, there is provided a printing method for performing a printing operation by a print head while supplying printing paper to a rotating drum and transmitting the printing paper clamped by a clamp that rotates together with the drum, the printing method includes the steps of: controlling the clamp such that only one side of the leading edge of the printing paper is clamped by the clamp at an initial supplying location of the drum, then rotating the drum to locate the leading edge of the printing paper onto an initial printing location of the drum, simultaneously releasing the clamp so that printing can start from the leading edge of the printing paper, and then re-clamping the printing paper at a point beyond the initial printing location to transfer the printing paper, and controlling the print head such that when the leading edge of the printing paper is located at the initial printing location, the other unclamped side of the leading edge of the printing paper is pressed by the print head, and then the clamp-released side of the leading edge of the printing paper can be pressed by the print head.

To perform the printing method, there is provided a printer including a rotating drum and a clamp installed only in one side of the drum so that only part of the leading edge of the printing paper can be clamped, the printer has: clamp controlling means for controlling the clamp such that only one side of the leading edge of the printing paper is clamped at the initial supplying location, then releasing the clamp when the leading edge of the printing paper is located at an initial printing, and then re-clamping the printing paper at a point beyond the initial printing location of the drum to transfer the printing paper, and print head controlling means for controlling the print head such that when the leading edge of the printing paper is at the initial printing location, the other unclamped side of the leading edge of the printing paper is pressed by the print head, and then the clamp-released portion of the leading edge of the printing paper can be pressed by the print head.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENT

A printing method according to the present invention will be explained through an embodiment of a thermal transfer printer which employs an ink ribbon having a sublimation-type ink deposited thereon.

Figure 1:
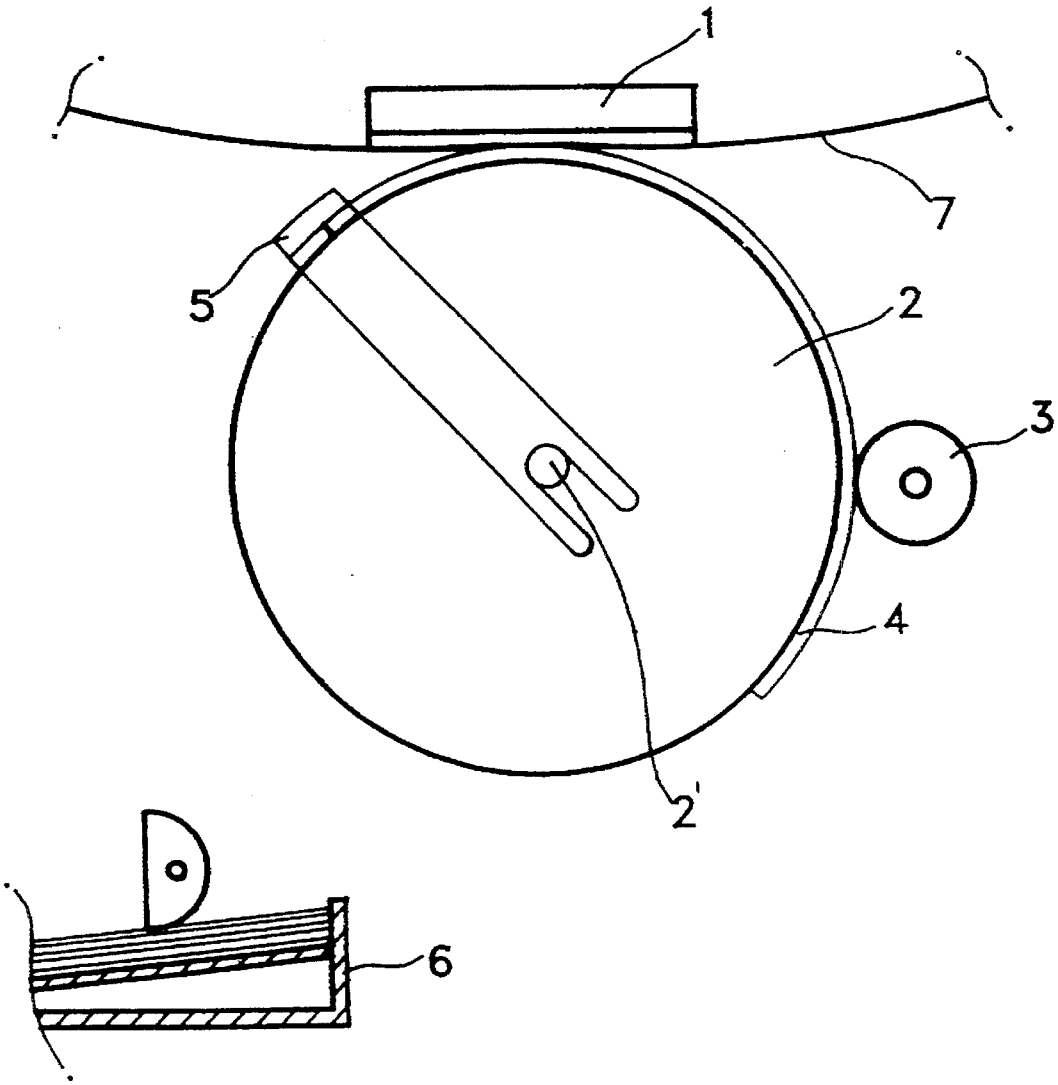
FIG. 1 (PRIOR ART)
FIG. 1 is a schematic view showing a conventional printer.
Figure 2:
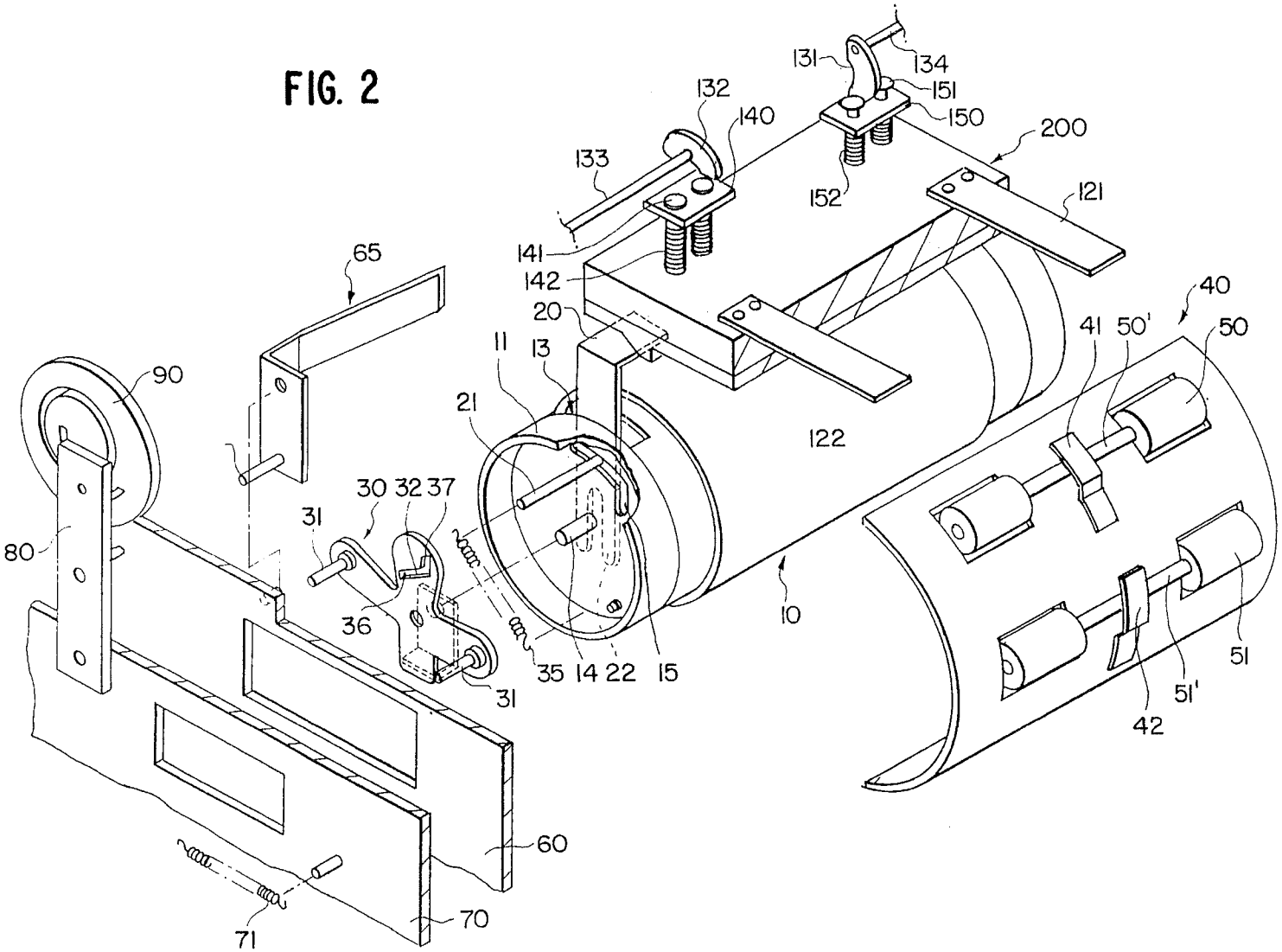
FIG. 2 is a schematic exploded perspective view showing a printer of the preferred embodiment of present invention.
Figure 3:
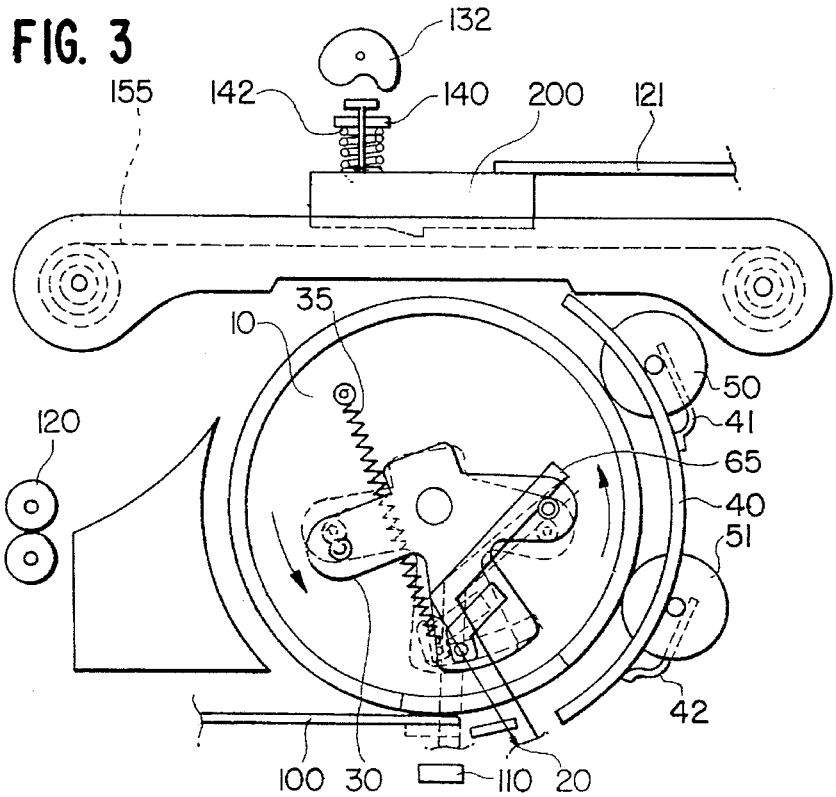
FIG. 3 to FIG. 9 illustrate operation of the preferred embodiment of the present invention.

Referring to FIGS. 2 and 3, printing method according to the preferred embodiment can be divided into a clamp 20 operation step and a print head 200 operation step.

The step for operating clamp 20 is as follows. One side of a sheet of printing paper 100 is clamped to a drum 10 at the initial supplying location of the drum. Then, clamp 20 is released when the leading edge of printing paper 100 is located at the initial printing location of drum 10. In addition, the leading edge of printing paper 100 is clamped again at a point beyond the initial printing location.

The step for operating print head 200 is as follows. The other unclamped side of printing paper 100 is pressed by print head 200 when the leading edge of printing paper 100 is at the initial printing location. Then, clamp 20 is released and the unclamped portion of the printing paper is pressed by print head 200.

In the step for operating the print head, cams 131 and 132 for selectively contacting and pressing respective sides of the print head are respectively installed above the upper portion of print head 200. Thus, print head 200 inclines according to the drive of cams 131 and 132 so as to sequentially press from one side to the other side of printing paper 100.

As described above, in a printing method of the present invention, only part of the leading end of printing paper 100 supplied at the initial supplying location is clamped by clamp 20. Then, drum 10 is rotated so as to transfer the leading edge of printing paper 100 to the initial printing location corresponding to the central portion directly under print head 200. Then, cam 131 operates to press one side of print head 200 so that the unclamped portion (i.e. the side opposite the clamped portion) of the leading edge of printing paper 100 can be pressed against print head 200. Then, clamp 20 is released and cam 132 is operated to press the other side of print head 200 so that the unclamped portion of the printing paper is pressed against drum 10 by print head 200. As a result, print head 200 presses the entire leading edge of printing paper 100.

In the above-described state, a printing operation is performed from the leading edge of printing paper 100 while rotating drum 10.

Now, a printing method according to the preferred embodiment will be explained in detail.

Figure 4:
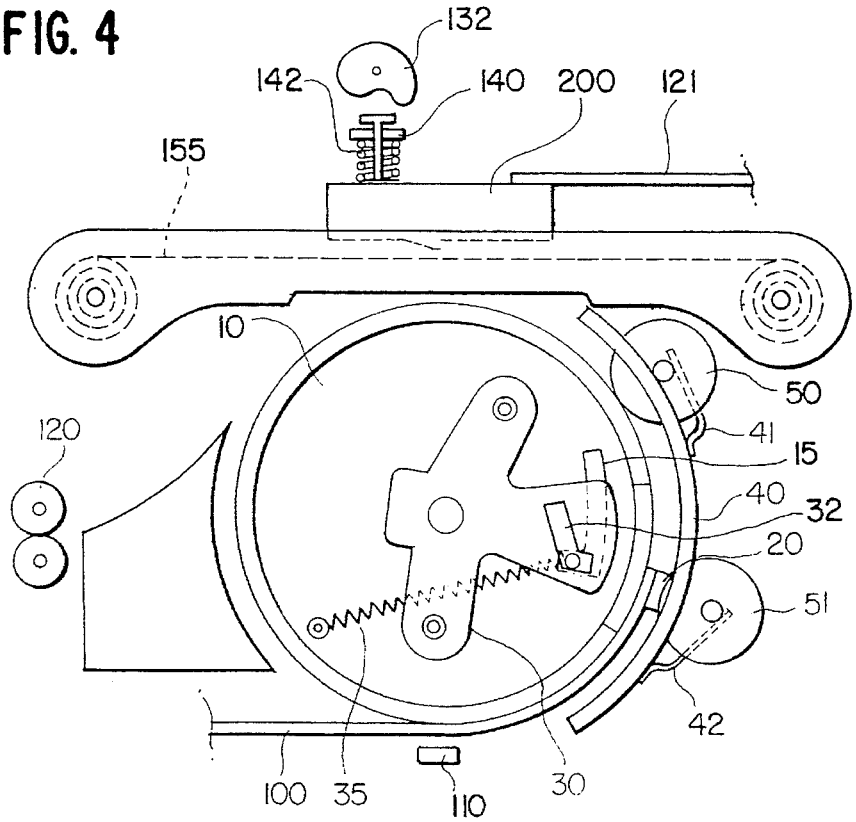
Figure 5:
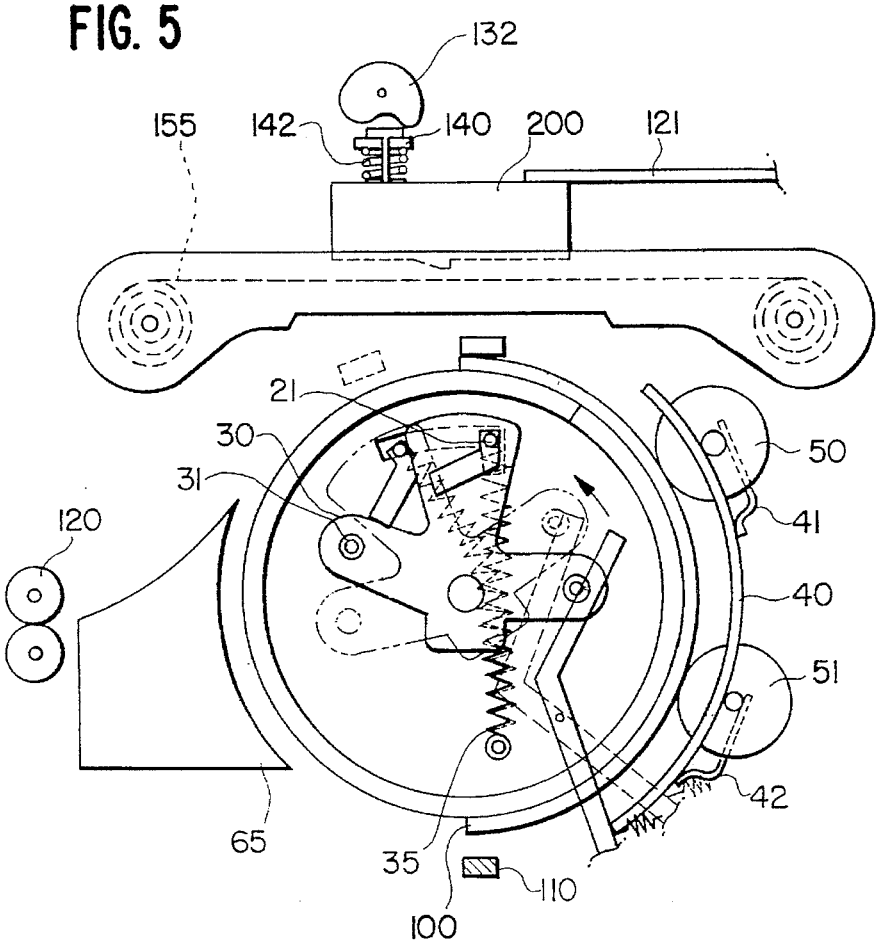
Figure 6:
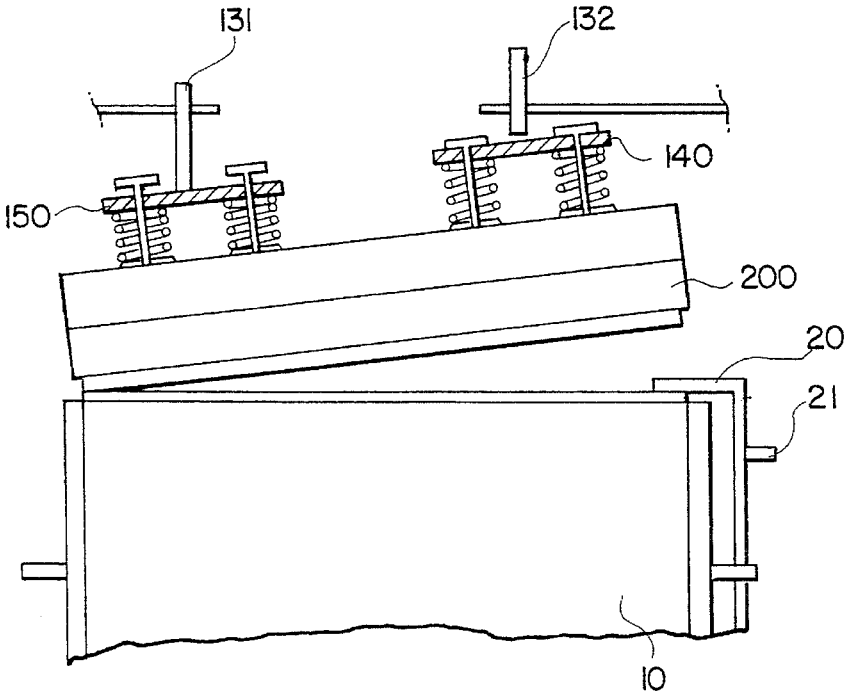

Referring to FIG. 2 to FIG. 9, drum 10 is supported by a frame 60 (the other side of the frame is not shown) in a rotatable manner. Drum 10 is selectively driven by a known driving device (not shown). Clamp 20 is coupled to a drum shaft 14 to be movable in a direction perpendicular to drum shaft 14 so that the leading edge of printing paper 100 can be clamped and unclamped. Here, since clamp 20 is installed on only one side of drum 10 as shown in FIG. 2 and FIG. 6, only part of the leading edge of printing paper 100, corresponding to a position below clamp 20, is clamped.

A sensor 110 for sensing the leading edge of printing paper 100 is installed below drum 10 whereon printing paper 100 is supplied. Sensor 110 senses printing paper 100 and feeds the sensor signal to the driving device, for example a stepping motor, for driving drum 10 so that drum 10 can be rotated by a number of predetermined steps. Print head 200, for heating in a predetermined pattern according to a print signal in a known manner, is installed above drum 10 to be movable up and down by a lifting device. An ink ribbon 155 having sequentially arranged colors of ink is installed between print head 200 and drum 10. Guide rollers 50 and 51 for guiding paper 100 while pressing the paper onto drum 10 are provided on a support member 40 positioned around drum 10. Shafts 50' and 51' of guide rollers 50 and 51 are elastically biased towards drum 10 by springs 41 and 42.

A clamp operating device operates clamp 20 such that only one side of the leading edge of printing paper 100 can be clamped to drum 10 at the initial supplying location of the drum, the clamp is released when the leading edge of paper 100 is at the initial printing location, and the leading edge of paper 100 can be re-clamped at a location past the initial printing location.

The present invention also includes print head operating means for operating print head 200 such that the unclamped portion of the leading edge of paper 100 can be pressed by print head 200, while the clamped portion of the leading edge of paper 100 is released, when the leading edge of paper 100 is at the initial printing location.

The clamp operating means is constituted as follows. Drum 10 can be rotated by driving means (not shown) and has shaft 14 which is supported by frame 60. Clamp 20 is coupled to drum shaft 14 and is movable in a direction perpendicular to drum shaft 14. Clamp 20, which is L-shaped, has an open slot 22 formed in one end thereof and is coupled to drum shaft 14 in a slidable manner. A linkage pin 21 protrudes from the side surface of clamp 20. An aperture 13 having a predetermined width for restricting a rotation angle of clamp 20 is provided in the side surface of drum 10. A flange 11 having a first cam slot 15 to which linkage pin 21 is slidable, is attached to the side surface of drum 10 having aperture 13. First cam slot 15 is substantially L-shaped. Here, the horizontal portion of first cam slot 15 extends along the circumferential direction of flange 11 while the vertical portion extends along a radial direction of drum 10. A lift 30 is coupled to shaft 14 outside flange 11. A second cam slot 32 in which linkage pin 21 is also slidable is formed in lift 30. Here, second cam slot 32 is also nearly L-shaped and has a horizontal slot portion 36 communicating with a vertical slot portion 37. Horizontal slot portion 36 is formed to extend substantially in the circumferential direction while vertical slot portion 37 is formed to extend substantially in the radial direction of the drum. Operating means for operating lift 30 so that linkage pin 21 can slide in first and second cam slots 15 and 32 are provided outside lift 30.

Lift 30 rotates by the lift operating means, and linkage pin 21 is guided into first and second cam slots 15 and 32 according to the rotation of lift 30. At this time, clamp 20 clamps or unclamps print paper 100. Specifically, clamp 20 clamps the leading edge of printing paper 100 when paper 100 is at the initial supplying location. At this state, the leading edge of printing paper 100 is unclamped due to the linkage between pin 21 and lift 30 when drum 10 and clamp 20 rotate together and clamp 20 passes the initial printing location. At the state where the leading edge of printing paper 100 is unclamped, clamp 20 moves with respect to drum 10 to a position beyond the initial printing location.

The lift operating means comprises a slide 70, installed on frame 60 in a slidable manner, a linkage lever 80 rotably mounted on frame 60 and having one end coupled to slide 70 and the other end coupled to cam 90 in order to operate slide 70, and an operation lever 65 whose one end is connected to slide 70 by a spring 71 and which is supported on frame 60 in a rotatable manner.

In the lift operating means, operation lever 65 rotates according to the right and left movements of slide 70, and thus, lift 30 being linked thereto also rotates. A pin 31 is formed in lift 30, and is struck by operation lever 65 so that lift 30 can be rotated when the lever rotates. Linkage pin 21 is connected by a spring 35 to a protrusion 11' formed in flange 11. Thus, a clamping state of clamp 20 can be restored with resilience when paper 100 is re-clamped from the unclamped state.

Meanwhile, printing paper sensor 110 is installed below an initial supplying location of drum 10 as shown in FIG. 3. Printing paper sensor 110 senses the leading edge of paper 100 supplied to drum 10, and simultaneously, the sensor signal is fed to a stepping motor (not shown) for driving drum 10. Thus, drum 10 rotates by the number of predetermined steps, to thereby transfer the leading edge of paper 100 up to the initial printing location.

Meanwhile, referring to FIG. 2, means for operating print head 200 comprises resilient cantilever supporting members 121 and 122 for supporting print head 200, movable plates 140 and 150 which are movable and which are pressed with resilience above both sides of the upper surface of print head 200, and pressing means for sequentially pressing movable plates 140 and 150.

The pressing means are constituted as follows. First, guide pins 141 and 151 are installed on both sides of the upper surface of print head 200. Springs 142 and 152 are coupled respectively to guide pins 141 and 151. Movable plates 140 and 150 are slidably supported on guide pins 141 and 151. Movable plates 140 and 150 compress springs 142 and 152 so that moveable plates 140 and 150 are biased upward on guide pins 141.

Cams 132 and 131 are respectively disposed above the upper surface of movable plates 140 and 150. Cams 132 and 131 are each supported by one end of cam shafts 133 and 134 which are operated by different drivers (not shown). Cams 132 and 131 selectively press the upper surfaces of movable plates 140 and 150 when rotated to a desired position. Print head 200 inclines as shown in FIG. 6 when one of moveable plates 140 and 150 are pressed.

The thus-constituted printer of the preferred embodiment operates in the following manner.

Referring to FIG. 2 to FIG. 5, when printing paper 100 is supplied to drum 10 from a paper supplying cassette (not shown), sensor 110 senses the leading edge of printing paper 100. At this time, the sensor signal is delivered, via a controller, to a motor (not shown) for driving cam 90 in order to rotate cam 90. Thus, linkage lever 80 rotates clockwise, which moves slider 70 to the left of FIG. 2. As a result, operation lever 65 connected to slider 70 by spring 71 rotates clockwise so as to hit pin 31 of lift 30. At this time, as shown in FIG. 3, lift 30 rotates clockwise, which moves linkage pin 21 of clamp 20 through cam slots 32 and 15 so that clamp 20 moves toward drum 10 and printing paper 100 can be clamped. That is, linkage pin 21 moves to a vertical portion of first cam slot 15 and moves downwards by spring 35, so that clamp 20 clamps the leading edge of printing paper 100.

Figure 7:
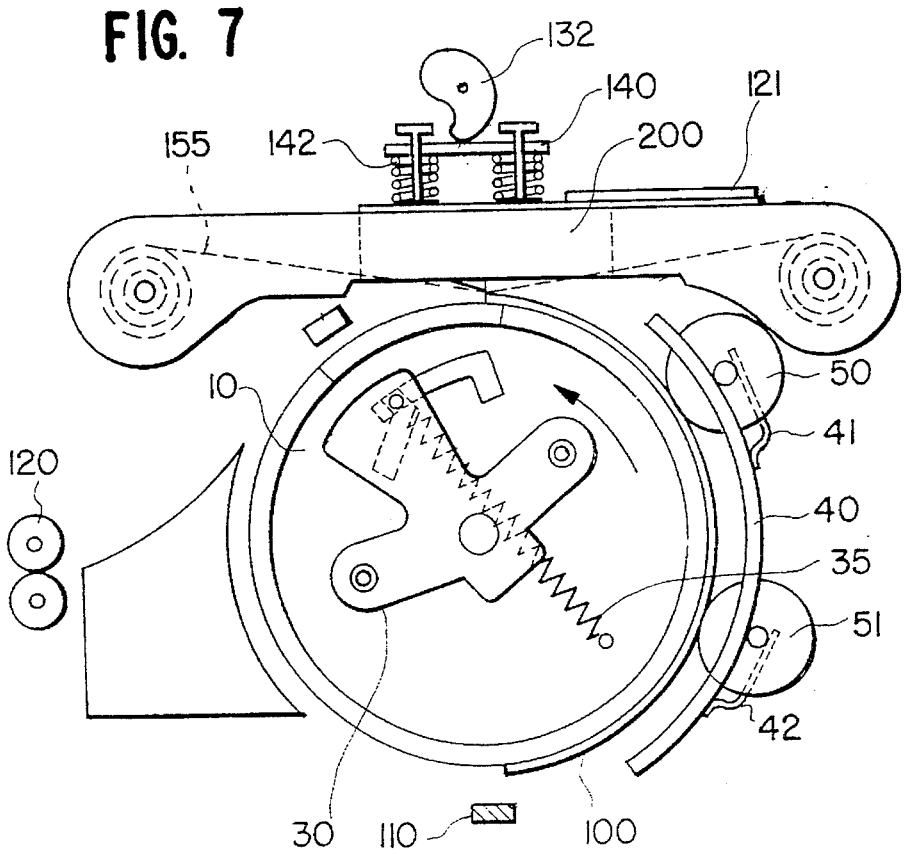

After clamp 20 clamps the leading edge of printing paper 100, signal from sensor 110 is fed, via a controller, to a motor (not shown) for driving drum 10. At the same time, as shown in FIG. 7, drum 10 rotates so that the leading edge of printing paper 100 can be located at the initial printing location opposing print head 200. When printing paper 100 is transmitted at the state where drum 10 and clamp 20 clamp the leading edge of printing paper 100, clamp 20 moves past guide rollers 50 and 51 by pushing guide rollers 50 and 51 as shown in FIG. 4. At this time, linkage pin 21 of clamp 20 rotates while being located in a vertical portion of first cam slot 15 and vertical slot portion 37 of second cam slot 32. Thus, clamp 20 is transmitted up to the initial printing location, as shown in FIG. 5, leaving the leading edge of printing paper 100 clamped by clamp 20.

Figure 8:
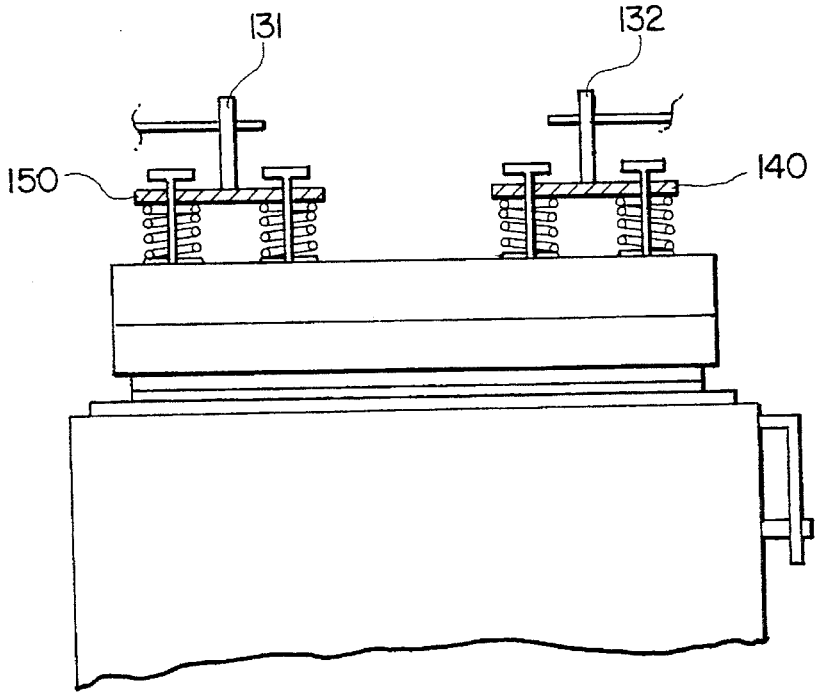

Then, as shown in FIG. 6, cam 131 located above the unclamped portion of printing paper 100 moves so as to press movable plate 150. Thus, print head 200 is inclined, resiliently bending resilient supporting members 121 and 122, to thereby press the unclamped side portion of the leading edge of printing paper 100. Immediately after the one side of printing paper 100 is pressed by print head 200, slider 70 moves to the right by the operation of cam 90 and operation lever 65 is caused to rotate counterclockwise due to interaction between lever 80, slider 70, spring 71 and lever 65 in reverse to the operation described above. Accordingly, as shown in FIG. 5, pin 31 of lift 30 rotates counterclockwise, due to the movement of operation lever 65. At this time, linkage pin 21 of clamp 20 moves along first and second cam slots 15 and 32 by the rotation of lift 30, which releases the clamped state. Simultaneously, clamp 20 rotates through a predetermined angle and moves to the location beyond the initial printing location as linkage pin 21 moves through the circumferential portion of cam slot 15 due rotation of lifter 30. At this time, the rotation angle of clamp 20 is restricted by the size of aperture 13 formed in drum 10, and spring 35 can be kept at the tension-biased state by operation lever 65. Then, when clamp 20 is released and moves beyond the initial printing location, movable plate 140 is pressed by the rotation of cam 132 as shown in FIG. 8. At this time, printing head 200 presses the entire leading edge of printing paper 100 unclamped from clamp 20. Thus, print head 200 evenly presses the leading edge of printing paper 100 after clamp 20 has moved out of the way, as shown in FIG. 7 and FIG. 8.

Meanwhile, when drum 10 is driven according to the signal of sensor 110 and the leading edge of printing paper 100 moves up to the initial printing location, drum 10 stops rotating and ink ribbon 155 is wound. Thus, a portion of ink ribbon 155 corresponding to one color among yellow, magenta and cyan stops at the initial printing location of print head 200. Cams 131 and 132 for pressing print head 200 are driven after the desired ribbon portion is positioned.

Figure 9:
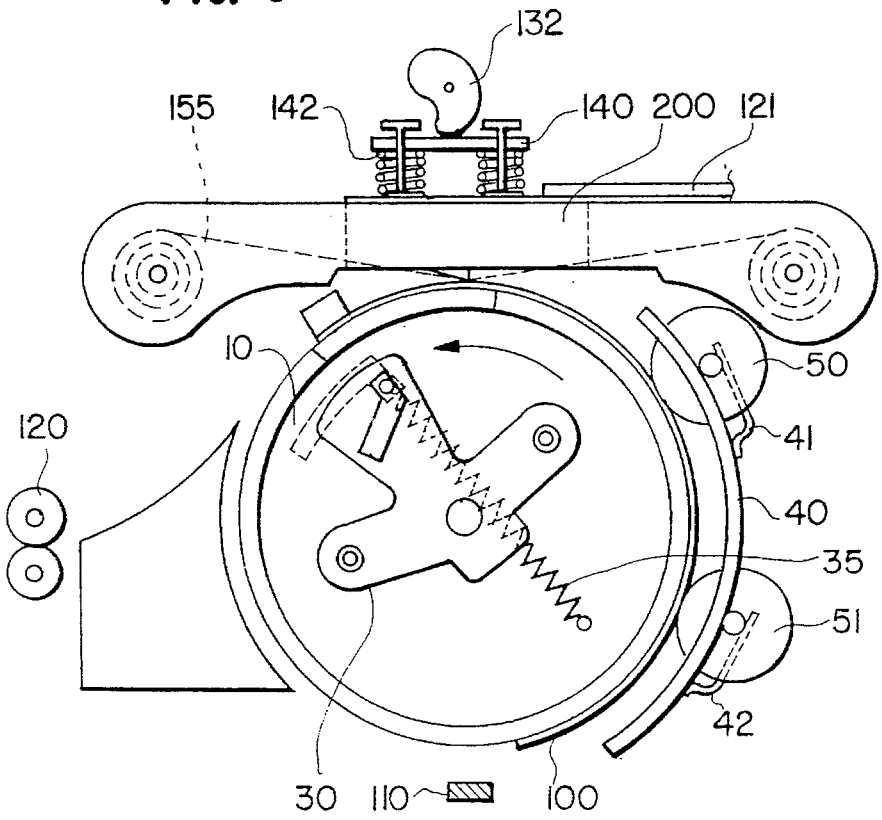
Figure 10:
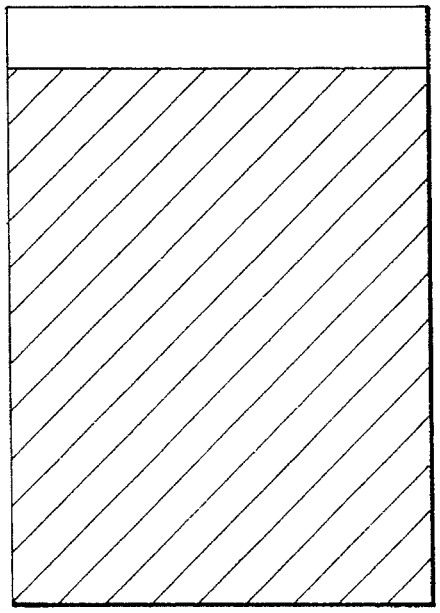
FIG. 10 PRIOR ART
FIG. 10 is a plan view showing the state of the paper printed by the conventional printer.

Print head 200 then presses/heats ink ribbon 155 according to a known type of printing signal as drum 10 rotates, to thereby perform a printing operation starting from the leading edge of printing paper 100. As shown in FIG. 9, the leading edge of paper 100 printed while drum 10 rotates counterclockwise is clamped again by clamp 20. That is, clamp 20 moves in a radial direction of the drum due to a restitution force of spring 35 as linkage pin 21 moves along first and second cam slots 15 and 32, to thereby clamp the leading edge of printing paper 100 after it has moved beyond the initial printing position.

Paper 100 printed from the leading edge of paper can be pressed closely and stably in contact with drum 10 and properly transported due to clamp 20 which clamps the leading edge of printing paper. When the leading edge of printing paper 100 is again located at the place where sensor 110 ceases its presence, another color is printed on the paper by repeating the above-described operation. Thus, the full color printing is performed by a repeated rotation of drum 10. Then, printing paper 100 is ejected via ejection roller 120 after the desired colors have been printed.

Figure 11:
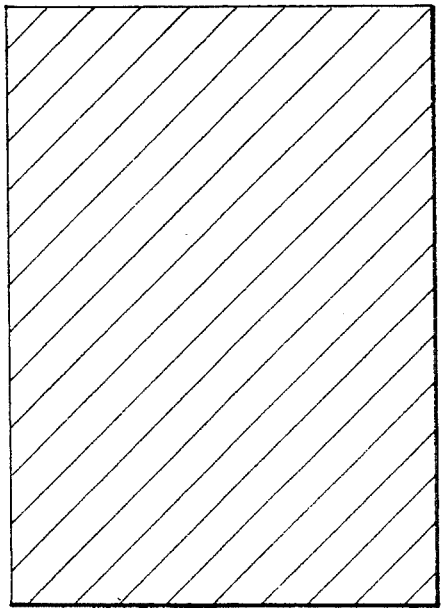
FIG. 11 is a plan view showing the state of the paper printed by the printer of the present invention.

As described above, a printing method and apparatus of the present invention enables printing of an image no edge margins as shown in FIG. 11. Control of the preferred embodiment can be accomplished by a known controller, known sensors, and known actuation devices. For example a preprogrammed microprocessor based controller, photosensors, stepper motors and solenoids can be used in a known manner to accomplish the disclosed functionality.

The invention has been described through a preferred embodiment. However, various modifications can be made without departing from the scope if the invention as defined by the appended claims.

What is claimed is:

1. A printing method for performing a printing operation by a print head while supplying a sheet to a rotating drum and transmitting the sheet clamped by a clamp that rotates together with the drum, said printing method comprising the steps of:

activating said clamp such that only one side of a leading edge of said sheet is clamped by said clamp at an initial supplying location of the drum, then rotating the drum to locate the leading edge of the sheet at an initial printing location of the drum;

releasing the clamp so that the leading edge of the sheet is unclamped after the leading edge has reached the initial printing location;

printing on the sheet starting from the leading edge and reactivating the clamp a point beyond the initial printing location to clamp the sheet and allow the sheet to be transported by rotation of the drum.

controlling the print head such that when the leading edge of said sheet is located at the initial printing location, an unclamped side of the leading edge of said sheet is pressed by the print head, and after said releasing step said one side of the leading edge of the sheet is pressed by the print head.

2. A printing method according to claim 1, wherein said step for controlling said print head is accomplished by cams which are disposed above the print head in order to selectively contact and press one or both sides of print head according to the operation state of the cams so that the sheet is selectively pressed by said print head on one or both sides of said sheet.

3. A printer including a rotating drum to which a sheet is supplied, and a clamp installed only on one side of the drum so that only the leading edge of a sheet can be clamped by said clamp as to perform a printing operation with a print head, said printer comprising:

means for controlling said clamp such that only one side of the leading edge of said sheet is clamped at an initial supplying location of the drum, then releasing the clamp when the leading edge of the sheet is located at an initial printing location of the drum, and then re-clamping the sheet at a point beyond the initial printing location of the drum to transfer said sheet as the drum is rotated; and print head controlling means for controlling said print head such that when the leading edge of said sheet is .at the initial printing location, an unclamped side of the leading edge of said sheet is pressed by the print head, and then after the clamp is released said one side of the leading edge of the sheet can be pressed by the print head.

4. A printer according to claim 3, wherein said clamp is L-shaped, and has one end coupled to a shaft of said drum, said clamp being movable in a direction perpendicular to said shaft, said clamp also having a protruded linkage pin formed thereon, said clamp extending through an aperture formed in one side of said drum to restrict rotation of said clamp, and wherein said clamp controlling means comprises:

a flange coupled to said drum and which has a first cam slot in which said linkage pin is slidably inserted;

a lift having a second cam slot in which said linkage pin is slidably inserted.

lift operation means for operating said lift such that said linkage pin can move in a direction perpendicular to said drum shaft while sliding along said first and second cam slots;

whereby said lift operation means, causes said clamp to release the sheet at the initial printing location, and re-clamp the sheet at a position beyond the initial printing location.

5. A printer according to claim 4, wherein said lift operation means comprises a frame supporting said drum, a slide which is slidably supported on the frame, a linkage lever whose one end is connected to the slide and whose other end is connected to a cam driver to operate the slide, and an operation lever whose one end is coupled to the slide by a spring and which is supported on said frame in a rotatable manner, said operation lever operating in response to the operation of said slide to operate said lift.

6. A printer according to claim 3, wherein said clamp is connected to said flange by a spring so that the clamp can be resiliently restored from an unclamped state to a clamped state.

7. A printer according to claim 3, further comprising a sensor for sensing the leading edge of the sheet installed at the initial supplying location of the drum so that the drum can rotate based on a signal from the sensor and transfer the leading edge of the sheet to the initial printing location.

8. A printer according to claim 3, wherein said print head controlling means comprises:

resilient supporting members for supporting said print head;

guide pins installed on respective sides of a surface of said print head;

movable plates each coupled with a respective one of said guide pins to be slidable on said guide pins;

a spring installed on said guide pins between the surface of said print head and each of the movable plates; and pressing means for selectively pressing said movable plates, thereby making the print head selectively press the sheet against the drum from one side of the drum to the other.

9. A printer according to claim 8, wherein said pressing means comprises cams which are each rotated by a predetermined driver to sequentially press the movable plates.

* * * * *